United States Patent [19]

Garcia

[11] Patent Number: 4,985,958

[45] Date of Patent: Jan. 22, 1991

[54] ROLLER TYPE APPLICATOR FOR PAINT

[76] Inventor: Ricardo Garcia, 5849 NW. 7th St., Apt. #503, Miami, Fla. 33126

[21] Appl. No.: 398,546

[22] Filed: Aug. 25, 1989

[51] Int. Cl.[5] ..... B05C 17/02

[52] U.S. Cl. ..... 15/114; 15/210 R; 15/230.11; 15/248 A

[58] Field of Search ..... 15/118, 230.11, 248 A, 15/114, 210 R

[56] References Cited

U.S. PATENT DOCUMENTS

| | | | |
|---|---|---|---|
| 3,085,270 | 4/1963 | Vosbikian et al. | 15/118 X |
| 3,346,899 | 10/1967 | Murphy | 15/230.11 X |
| 3,942,209 | 3/1976 | Walls | 15/248 A X |
| 4,528,712 | 7/1985 | Leibow | 15/230.11 X |
| 4,829,623 | 5/1989 | Brezette et al. | 15/230.11 X |

FOREIGN PATENT DOCUMENTS

| | | | |
|---|---|---|---|
| 887294 | 1/1962 | United Kingdom | 15/248 A |
| 1377971 | 12/1974 | United Kingdom | 15/118 |

*Primary Examiner*—Chris K. Moore

*Attorney, Agent, or Firm*—Malin, Haley, McHale, DiMaggio & Crosby

[57] ABSTRACT

A paint applicator designed to effectively paint a given surface area such as a wall, ceiling or the like including an applicator roll rotatably mounted within a housing and further including a secondary applicator element attached to the housing and configured to transfer paint to a surface junction of surfaces being painted as well as partially define a return path of excess paint flowing back to the applicator or interior portions of the housing.

2 Claims, 2 Drawing Sheets

ROLLER TYPE APPLICATOR FOR PAINT

BACKGROUND OF THE INVENTION

1. Field of the Invention

This invention relates to an applicator assembly including an applicator roll and a secondary or supplementary applicator element both mounted on a housing and extending outwardly from an open face thereof when the applicator roll is designed to paint a relatively large surface area such as walls or surfaces and the secondary applicator is designed to apply paint to the junctions of such wall or ceiling surfaces.

2. Description of the Prior Art

Numerous devices have been introduced into the prior art for the purpose of transferring or spreading paint or like material unto a given surface. In addition to the wide variety of designs of simple or basic paint brushes, paint applicator designs include relatively complex structures.

Prior art paint applicators include an applicator roll which can rapidly and effectively apply a paint over relatively large surface areas in an efficient manner. Such rolling of paint unto a surface has been found to be much quicker than "stroking" with a conventional paint brush. Where such applicator rolls are allowed to be used such as on large, relatively flat planar surfaces the rolls have been found to be more efficient than a brush and much less costly especially when considering the man or labor hours involved.

However, certain disadvantages have become associated with the use of applicator rolls. The overall painting with this type of applicator roll structure has frequently been found to be messy, often times resulting in the waste and loss of paint. In the prior art, applying paint to the roller surface usually includes a roll tray having an inclined base at least partially filled with paint in which the applicator roll is reciprocally moved. Paint is transferred on to the outer surface of the roll and then the roll is of course movably applied over the surface being painted. In addition to the loss of paint through waste, there is of course the requirement for relatively additional, specifically constructed containers in the form of a tray requiring the applicator roll to be constantly "dipped" into the tray. The applicator roll has received wide acceptance primarily due to its rapid even spreading of paint onto a given surface. However, the industry is desires of overcoming recognized disadvantages by providing a more efficient structure which accomplishes the overall result of painting in the same accepted manner but which is more efficient, less messy but yet is easy to operate and maintain. The following U.S. and foreign patents are representative of prior art attempts to overcome the problems set forth above and long recognized as existing in the prior art. Such patents include U.S. Pat. Nos. to Boyle; 375,919 Peterson, 356,695; Fernandez, 1,376,195; Sporer, 1,461,947; Rufo, 2,307,858; Tucker, 2,538,542; 2,548,,653; Leverock, 2,583,432; Ballard et al 3,403,960; Chrun, 2,746,071; Pedro, 2,928,1113; Cassidy, 3,193,868; Clark et al, 3,231,151: Schultz, 3,274,637; Ellis, 3,690,779; Ogenibene, 3,721,502; Bradshaw, 3,809,484; Hansen, 3,825,970; Linton, 3,925,927; Spransy, 4,012,151; Rearai, 4,059,358; Gamacher, 4,129,391; Garcia, 4,140,410; Miller, 4,222,678; British Patent Nos. 14,024, 887,294 and 480,837; Swiss Patent No. 421,769; and German Patent No. 2,447,848.

SUMMARY OF THE INVENTION

The present invention is directed towards an applicator assembly of the type designed to apply paint to wall surfaces such as walls, ceilings , etc., and also, which is specifically structured to apply paint to the side edges and or junctions of such wall surfaces. In the present invention, an applicator roll is rotatably mounted within a housing means. The housing means is in the form of a hood assembly, depending upon the specific embodiment utilized which will partially surround the applicator roll. A secondary applicator structure, is designed to apply the paint to the peripheral edges and junction portions of such wall surfaces. The applicator roll as well as the secondary applicator are removably mounted on or within the housing.

The secondary applicator element, wherein the applicator roll may be considered the primary applicator element, is in the form of an elongated brush or sponge like member. The elongated applicator brush is removably secured to a leading edge portion of the hood assembly or other mounting structures, depending upon the particular embodiment utilized. In one such preferred embodiment the applicator element is mounted on a handle which is also secured to the applicator roll. A mounting means serves to allow the tilting or angular adjustment of the secondary applicator relative to the handle and more importantly the plane of the surface which is being painted. Accordingly, the secondary applicator can be selectively moved between an operative and an inoperative position. Such selective angular orientation also allows the applicator element to be more effectively positionable in to "hard to reach" areas for applying paint thereto.

Yet another embodiment of the present invention includes the secondary applicator element having a leading edge or leading portion thereof specifically disposed and configured to at least partially define a return path of travel of excess paint applied to the surface being painted. More specifically, the elongated brush element of the secondary applicator is disposed in spaced relation but substantially adjacent to a leading portion of the housing on which it is mounted. This cooperative disposition allows excess paint on the painted surface to be removed therefrom and channeled into the housing and into engagement with the applicator roll from which is redistributed on the surface being painted.

BRIEF DESCRIPTION OF THE DRAWINGS

For a fuller understanding of the nature to the present invention, reference should be added to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
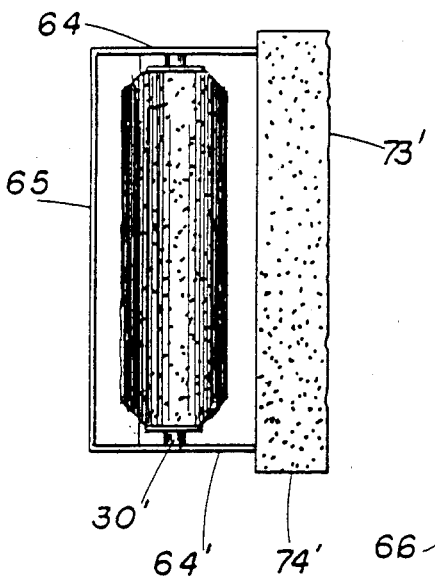
FIG. 2 is a bottom detailed view of the embodiment of FIG. 1.
Figure 1:
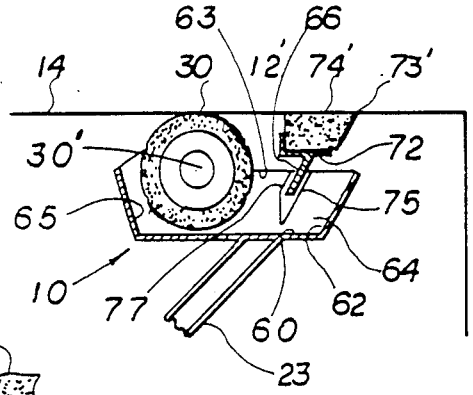
FIG. 1 is a longitudinal sectional view in partial cutaway of one embodiment of the present invention and including a primary applicator roll and a secondary applicator element.
Figure 6:
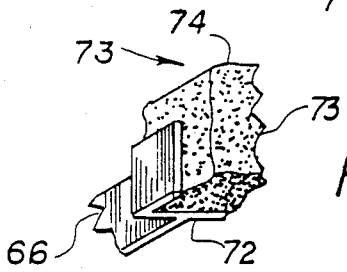
FIG. 6 is a detailed and partial cutaway of the extreme end portion of the secondary applicator of the present invention.
Figure 3:
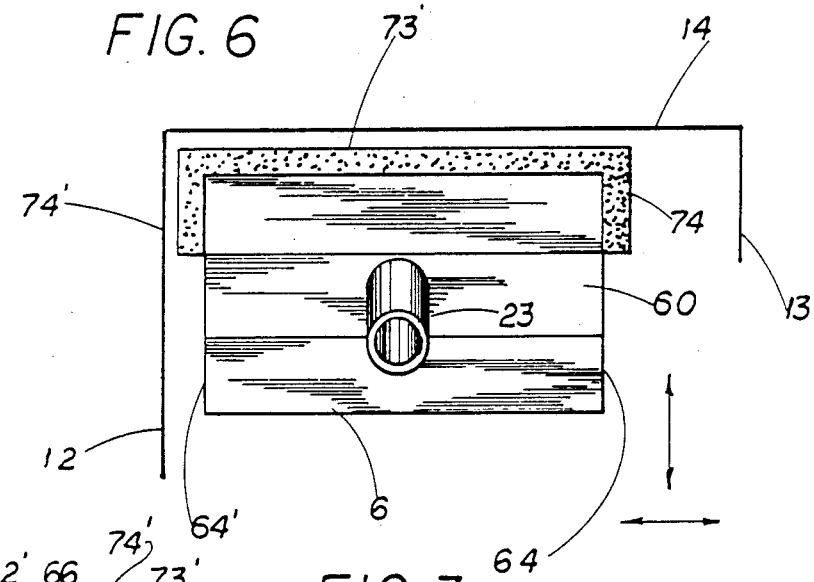
FIG. 3 is an sectional top view of the embodiment of FIG. 1.
Figure 4:
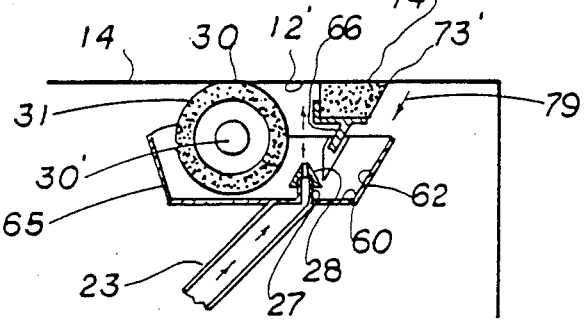
FIG. 4 is a transverse sectional view of yet another embodiment of the present invention.
Figure 5:
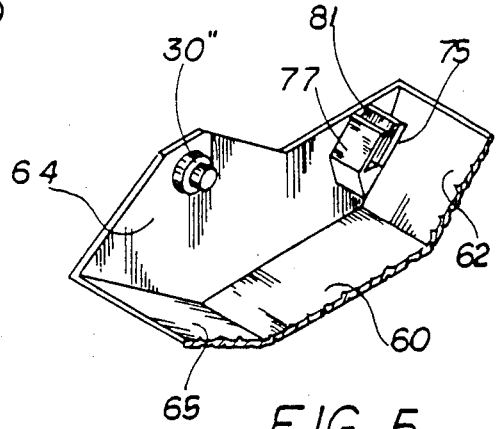
FIG. 5 is a perspective view in partial cutaway showing details of the housing structure of the present invention.
Figure 7:
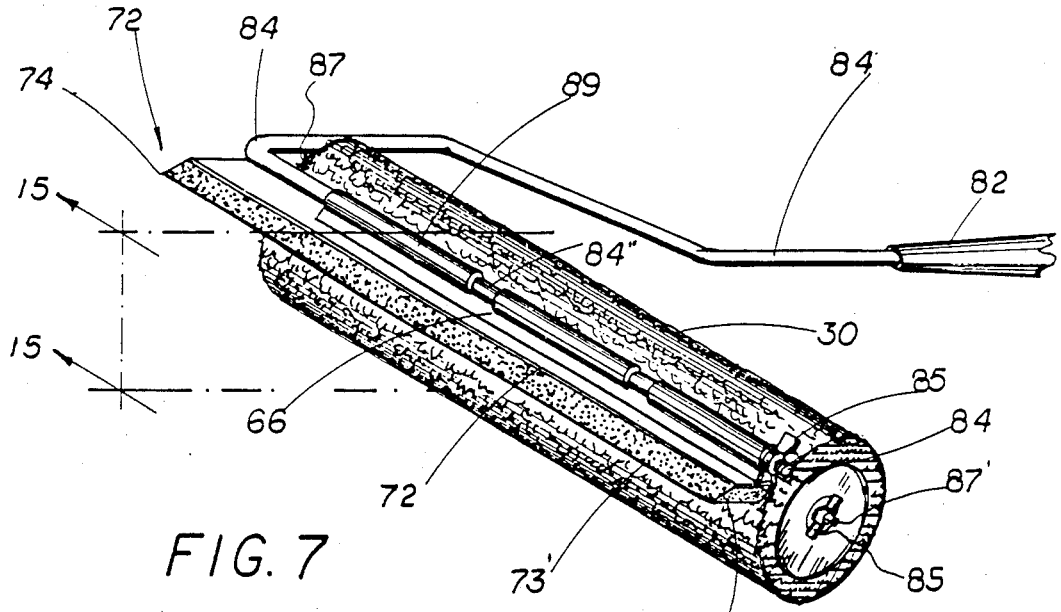
FIG. 7 is a perspective view of yet another embodiment of the present invention wherein the applicator assembly is absent in a surrounding hood or housing.
Figure 9:
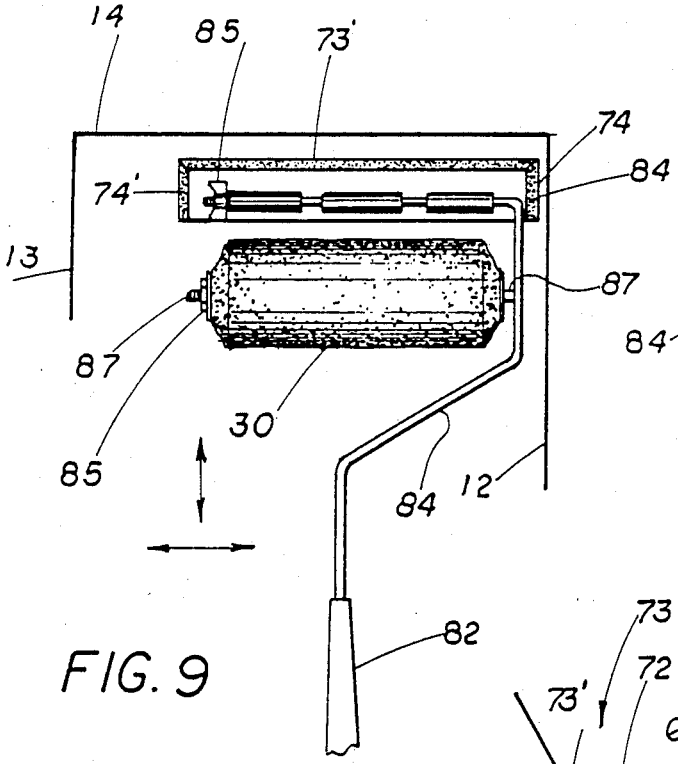
FIG. 9 is a top view of the embodiment of FIG. 7 in an operative position.
Figure 8:
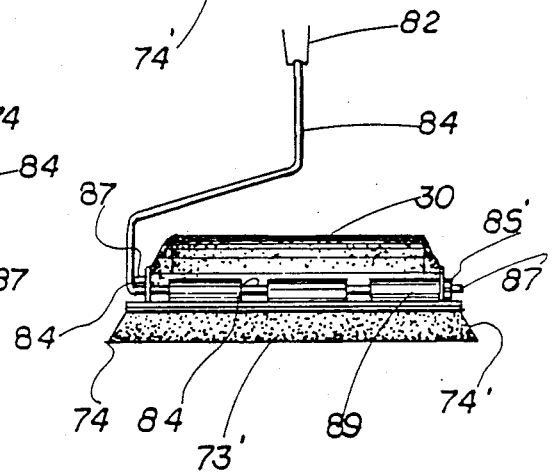
FIG. 8 is a front view and partial cutaway of the embodiment of FIG. 7.

A preferred embodiment of the present invention is shown in FIGS. 1 through 6 wherein the applicator assembly is generally indicated as 10 and includes a housing base 60 and front and rear walls 62 and 65 respectively. Opposite end walls 64 and 64' (see FIG. 2) are disposed in interconnecting relation to the front and rear walls 62 and 65 respectively thereby providing a substantially open mouth hollow interior portion of the housing. An applicator roller or roll 30 is rotatably mounted on the interior of the housing by having its opposite end portions at 30' being indented or including a socket so as to fit within and receive the mounting fingers 30" (see FIG. 5). Receipt of the endmost sockets 30' rotatably onto the outwardly projecting fingers 30" serve to allow free rotation of the applicator roll 30 so as to apply paint to various surfaces 12, 13 or 14 (see FIG. 3). However, in the embodiment of FIG. 9, the applicator roll 30 may include an interior elongated, supporting shaft 87 passing through the interior of the roll (not shown for purposes of clarity) and being rotatable thereon. The outer sponge like material as at 31 (FIG. 4) is structured to receive the paint thereon. The outer material 31 is disposed cylindrically about the entire outer portion of the supporting roll or shaft and in fact will define the outer surface thereof. As should be apparent the applicator roll 30 is used to apply paint to generally large surface areas such as the major exposed surface of either the side walls 12 or 13 or ceiling 14 of a given room or the like. A secondary applicator generally indicated as 73 is provided in the form of an elongated brush which team also includes a strip of sponge or may be formed of at least partially absorbent, cushioning, sponge-like material. The secondary applicator 73 has an elongated configuration and is more specifically defined by a bottom 72 and opposite ends, 74 and 74' and further by a front or leading portion 73'. The secondary applicator 73 is secured to the housing generally through the open mouth portion thereof as at 63. The elongated extension portion 66 embraces the under portion of the elongated pad as at 72 and as clearly shown in FIGS. 1, 4 and 6. Further, mounting brackets 77 having opening slots 81 formed therein are secured to the sidewalls as at 64 and are provided to engage corresponding ends of the elongated extension 66 in order to removably mount the supplementary applicator 73 in the position best shown in FIG. 1 through 4. In such a position the elongated, secondary applicator 73 is disposed to provide paint to the peripheral surface junctions as shown in FIGS. 1 and 4 of adjacent and interengaging surfaces. Such a position or peripheral, junction portion of mating surfaces cannot be reached easily by the applicator roll 30 and more importantly, paint cannot be efficiently applied to such a junction portion. Also, it should be noted that the overall cross-sectional configuration of the supplementary applicator or pad particularly as at the leading edge 73' serves to remove excess paint from the surface which is in contact with the supplementary applicator 73 and generally direct or channel it back into the interior in a direction generally represented by arrow 79.

Further, the embodiments of FIGS. 1 through 6 differ only in the extent of means of supplying the paint to the applicators 30 and 73. In the embodiment of FIGS. 1 through 3 the paint may be applied by a supply tray or like container, by hand. In this embodiment the handle 23 used to manipulate the housing is disposed in non-communicating relation with the interior of the housing and effectively ends at the bottom or base portion of the housing 60.

To the contrary, the embodiment of FIG. 4 shows that a forced fluid flow passes through the interior of the handle 23 and into the interior of the housing by inlet 27 and more specifically by a nozzle 28. Such forced fluid flow can occur through a pump means (not shown for purposes of clarity) which directs paint onto the surface as at 12' being painted wherein such paint can then further be distributed by either the applicators 30 or 73.

In the embodiment of FIGS. 7 through 10, an elongated handle 84 has a gripping portion 82 at one end. A first support 87 serves to rotatably mount the applicator roll 30 thereon. A locking nut or like connector as at 85 is secured to the distal end 87' in order to maintain the applicator roll in its intended, operative position.

Further, the elongated rod 84 has at its end, opposite to the handle grip 82, a mounting for the auxiliary or supplementary applicator generally indicated as 73. Such supplementary applicator 73 includes an elongated configuration with the same general parts and overall configuration as the supplementary applicator 73 in the embodiments of FIGS. 1 through 6. The end 84 is in the form of outwardly extending arm 84" which terminates at an end 84' and has connected thereto a connector as at 85' serving to affix the elongated, secondary applicator 73 thereto. However, means to mount the applicator 73 includes the elongated extension 66 having a plurality of spaced apart sleeves 89 dimensioned to receive and surround the arm 84". Relative dimensions of the sleeves 89 and the arms 84" are such as to allow a forced, pivotal or rotational positioning of the arm 66 into and out of its operative position. As demonstrated more clearly in FIG. 10 the applicator 73 is in its operative position in contact with the surface A. However such auxiliary applicator 73 can readily be rotated out of its operative position as indicated by directional arrow 91 through an ark of a substantially 120 degrees. When so disposed, out of its operative position the applicator roll 30 is free to pass over the entire surface without fear of the secondary applicator 73 inadvertently contacting the same or an adjacent surface.

Figure 10:
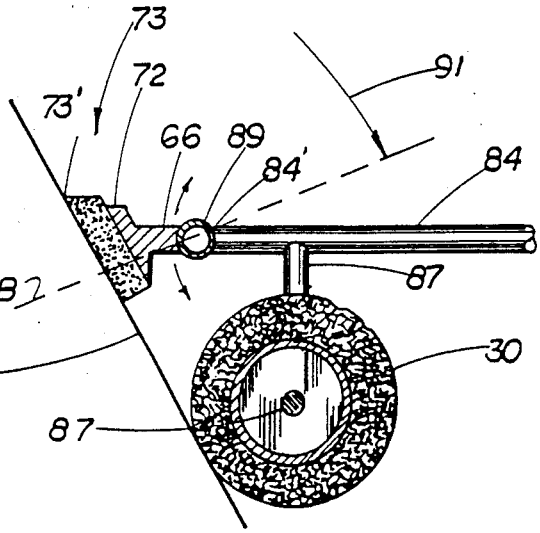
FIG. 10 is sectional view and partial cutaway of the embodiment of FIGS. 7 through 9.

It should be readily apparent that the embodiment of FIG. 7 through 10 differs from the embodiment of FIGS. 1 through 6 by the options of a housing but has certain additional structural features such as the ability to pivot or rotationally position the secondary applicator 73 out of its operative position as pictured in FIG. 10.

Now that the invention has been described,

What is claimed is:

1. An applicator assembly designed to apply paint to a surface and junction of two intersecting surfaces, said assembly comprising:

a. a housing having an angled front face, rear face, and two interconnecting end walls disposed in surrounding relation to an open interior wherein the peripheral edges of such walls define an open mouth accessible to said open interior, said angled front face having a distal end surface, b. an applicator roll rotatably mounted within said housing and disposed to have a portion thereof projecting outwardly from the open interior through said open mouth, c. a secondary applicator element including mounting means, said mounting means being within said housing and said secondary applicator element being in spaced relation to said applicator roll and extending outwardly from said open interior through said open mouth, d. said secondary applicator comprising an elongated configuration having a leading face, said leading face being disposed in space, substantially parallel relation to the front face of said housing but in outwardly spaced relation thereto, e. said secondary applicator including an elongated brush disposed and configured to provide paint distribution at a junction of the intersecting surfaces being painted, said brush having a front face;

f. said angled front face of said housing disposed in cooperative relation to a front face of said brush so as to define a return path of fluid flow of paint along said front face of said brush and between said brush front face and the front face of said housing, said brush front face being generally parallel to the housing front face, g. both said front face of said brush and said front face of said housing being oriented at an angle of less than 90° relative to the surface being painted when in an operative position and said front face of said brush and housing being angularly oriented in a direction towards the roll in said housing, i. said applicator roll and said housing to direct paint flow along said return path of fluid flow onto said applicator roll, j. said brush being removably mounted within said housing assembly and includes a mounting base extending substantially along the base length and along the length of said housing assembly, said mounting base including at least one exposed surface disposed at least partially within said housing and defining a portion of said return path of fluid flow, whereby excess paint applied to said surface being painted is at least partially returned to said applicator assembly along said return path of fluid flow, k. said mounting base comprising an elongated, linearly configured flange having a longitudinal dimension sufficient to have opposite ends thereof removably engage opposite end walls of said housing, attachment means secured to interior surfaces of opposite end walls of said housing and structured for supporting engagement of correspondingly positioned opposite ends of said flange, and l. said attachment means comprising two brackets each securely fastened to an inner surface of a different one of said opposite end walls of said housing and each bracket including an open ended channel dimensioned to receive a corresponding end of said flange therein, in retaining engagement therewith.

2. An assembly as set forth in claim 1 wherein said open end of said channel is in coplanar relation with the distal end surface of said housing front face.

* * * * *